United States Patent [19]

Brenner

[11] 3,968,846

[45] July 13, 1976

[54] AUGER WIPER

[75] Inventor: Gordon M. Brenner, Walnut Creek, Calif.

[73] Assignee: M.G.B., Inc., Berkeley, Calif.

[22] Filed: May 9, 1975

[21] Appl. No.: 575,938

[52] U.S. Cl. ..... 175/84

[51] Int. Cl.[2] ..... E21B 41/00

[58] Field of Search ..... 175/84, 313; 172/169, 172/606

[56] References Cited

UNITED STATES PATENTS

| | | | |
|---|---|---|---|
| 1,356,125 | 10/1920 | Chattstrom | 175/84 |
| 1,602,375 | 10/1926 | Gibson | 175/84 |
| 1,612,186 | 12/1926 | Gibson | 175/84 |

*Primary Examiner*—James A. Leppink
*Attorney, Agent, or Firm*—Naylor, Neal & Uilkema

[57] ABSTRACT

A wiper for scraping debris from between the convolutions of an earth boring auger. The wiper comprises a "daisy-like" wheel having radially extending peripheral fingers successively engagable between the convolutions of the auger to scrape debris therefrom. The wheel is mounted adjacent the auger for rotation about an axis disposed in a plane generally normal to the longitudinal axis of the auger whereby, when the wheel is engaged with the auger, rotational and/or longitudinal movement of the auger functions to rotate the wheel to successively move its fingers into and out of engagement between the convolutions of the hanger. An hydraulic cylinder is provided to selectively move the wheel into or out of engagement with the auger.

5 Claims, 3 Drawing Figures

AUGER WIPER

BACKGROUND OF THE INVENTION

The present invention relates to a wiper for scraping debris from between the convolutions of a continuous flight auger and particularly is concerned with such a wiper which permits unrestricted rotational and longitudinal movement of the auger.

The prior art, relating to wipers or scrapers for earth boring drills, is well developed in the art relating to rotary drill bits. The following U.S. Pat. Nos. are representative of such art: 1,908,049; 2,041,467; and, 2,654,578. The scrapers of these patents are relatively immovable and would not be suitable for employment with continuous flight augers, of the type with which the present invention is concerned.

Movable scrapers for use on various types of implements, such as plows, are also known in the art. The plow clearer of U.S. Pat. No. 122,155 is representative of such a scraper. Scrapers of this type are not suggestive of the present invention because they are in no way concerned with the provision of a scraper or wiper which permits the unrestricted rotational and longitudinal movement of a continuous flight auger.

Continuous flight earth boring augers of the type with which the present invention is concerned find principal use in the drilling of holes for foundations and the like. The most customary way of cleaning such augers is to remove the auger from the earth and spin the debris therefrom. Although this method is relatively effective, it has the disadvantage that it requires the auger to be lifted from the hole being drilled. It also has the disadvantage that the flight of the auger is not continuously cleaned during the drilling process.

SUMMARY OF THE INVENTION

In broad terms, the wiper of the present invention comprises successive scraper means engageable between the convolutions of a continuous flight auger to scrape debris from between the convolutions upon rotation of the auger about its longitudinal axis. Means is provided for mounting the scraper means for movement relative to the auger when engaged therewith whereby scraper means successively moves into and out of engagement with the convolutions in response to rotational and/or longitudinal movement of the auger.

The principal object of the present invention is to provide a wiper capable of continuously cleaning the convolutions of a continuous flight auger without interfering with rotational or longitudinal movement of the auger.

Another object of the invention is to provide such a wiper which operates in response to rotation of the auger and requires no auxiliary driving means.

Still another object of the invention is to provide such a wiper which may be selectively moved in and out of wiping engagement with the auger with which it is used.

A further object of the invention is to provide such a wiper which is capable of effectively removing highly adherent and gummy debris from between the convolutions of a continuous flight auger.

Still another object of the invention is to provide such a wiper which is of simple and relatively inexpensive construction and requires a minimum of attention and maintenance.

The foregoing and other objects of the invention will become more apparent when viewed in light of the following description and accompanying drawing.

DESCRIPTION OF THE ILLUSTRATED EMBODIMENT

Figure 1:
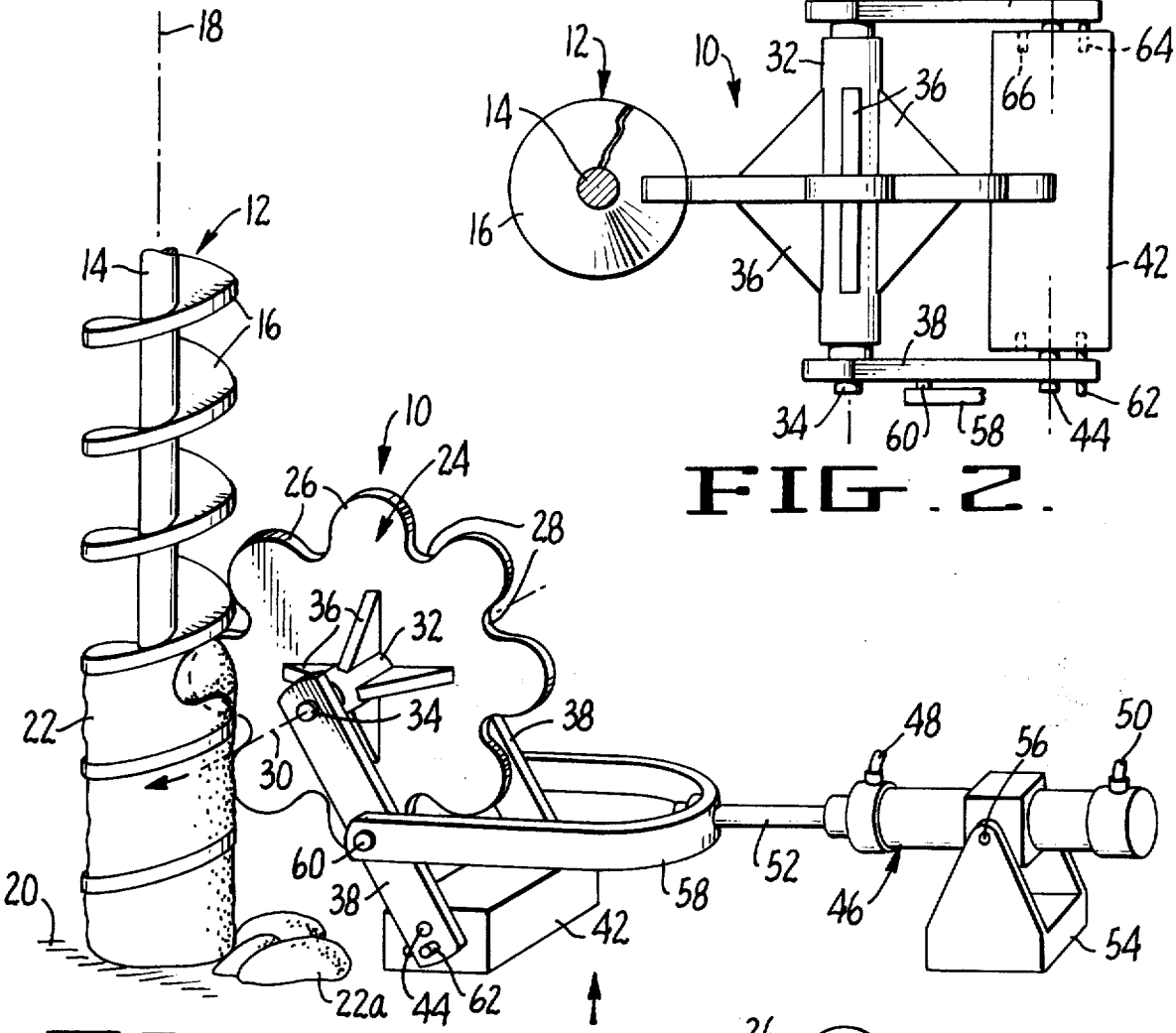
FIG. 1 is a perspective side elevational view of the wiper of the present invention, shown engaged with a continuous flight earth boring auger.

The wiper mechanism illustrated in the drawings is designated in its entirety by the numeral 10 and the continuous flight auger shown in combination therewith is designated by the numeral 12. The auger is of conventional construction and comprises a central shaft 14 having helical convolutions 16 extending therearound. In operation, the auger rotates about its longitudnal axis and moves axially of that axis as it bores into the earth. The longitudinal axis is designated by the numeral 18.

As illustrated in FIG. 1, the auger is shown boring into the earth, designated 20, and the earth debris collected in the continuous flight of the auger is designated 22. The numeral **22*a*** designates earth debris that has been removed from the auger through use of the wiper of the invention.

The principal element of the wiper 10 comprises a "daisy wheel" 24 having a plurality of fingers 26 extending radially therefrom at spaced intervals. As may be seen best from FIGS. 1 and 3, the fingers 26 are proportioned for slidable engagement between the convolutions of the auger 12 and the interval between adjacent fingers is sufficient to span the edges of the convolutions. The intervals between adjacent fingers are designated by the numeral 28.

Figure 2:
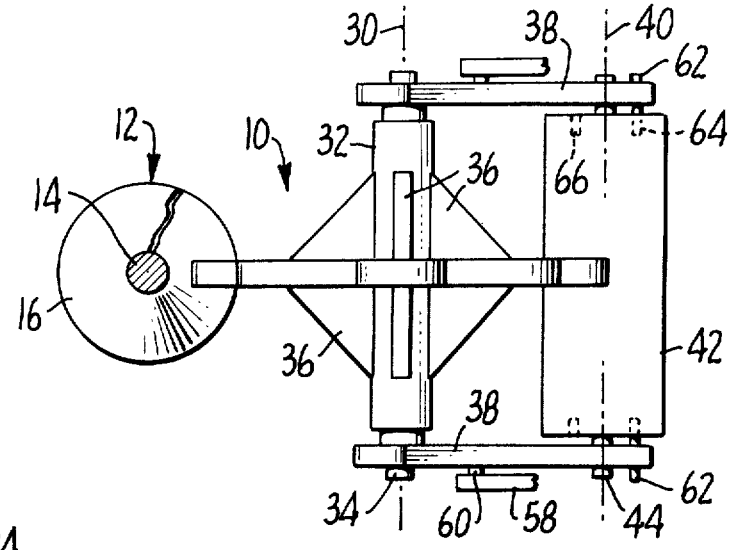
FIG. 2 is a plan view of the wiper and auger shown in FIG. 1, with parts thereof broken away; and, FIG. 3 is a side elevational view of the wiper and auger shown in FIG. 1, with parts thereof broken away and a phantom line illustration representing the position of the wiper support when the wiper is moved out of engagement with the auger.

The daisy wheel 24 is mounted for rotation about an axis, designated 30, disposed in a plane normal to the longitudinal axis 18 of the auger 12. In the preferred embodiment illustrated, the daisy wheel 24 and the axis 18 are disposed in a common vertical plane (See FIG. 2).

Mounting of the daisy wheel is provided through means of a hub 32 fixed centrally of the wheel and extending normal thereto and an axle 34 extending through the hub. The connection between the wheel and the hub is reinforced by webs 36 fixed therebetween. Rotation of the wheel about the axis 30 may be provided by either journaling the hub 32 on the axle 34 or journaling the ends of the axle 34 in bearings.

The ends of the axle 34 are received in parallel arms 38 disposed to either side of the wheel 24 and these arms are journaled about a common axis 40 at their lower ends. The journals for the lower ends of the arms 38 are mounted on a mounting block 42 and designated by the numeral 44. The mounting block 42 may be mounted adjacent the auger 12 by any suitable means. Typically, the structure carrying the drive mechanism for the auger would also support the mounting block 42.

Figure 3:
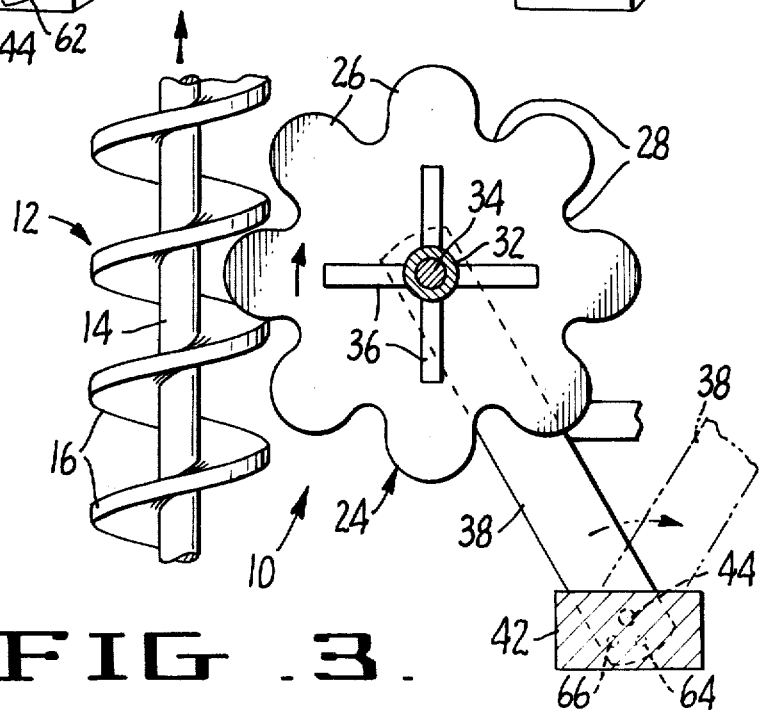

As a result of the pivotal connection of the arms provided by the journal 44, the daisy wheel 24 may be moved in and out of engagement with the auger 12. The phantom line illustration of the arm 38 in FIG. 3 shows the disengaged position. In the preferred embodiment illustrated, movement between the engaged and disengaged positions is provided by a double acting expansible hydraulic cylinder 46. The cylinder 46 is of conventional construction and includes hydraulic lines 48 and 50 leading to opposite ends thereof and piston rod 52 extending from one end of the cylinder. As is conventional, the piston rod moves in and out of the cylinder to provide for extension and retraction thereof.

The cylinder 46 is mounted on a pedestal 54 through a journal connection 56 so that the cylinder may rock about an axis parallel to the axis 40. The pedestal 54 is secured against movement relative to the mounting block 42 and generally is mounted on the same framework which supports the mounting block 42.

Connection between the cylinder 46 and the arms 38 is provided by a stirrup 58 fixed at one end of the piston rod 52 and journaled at the other end to the arms. The journals between the stirrup and the arms are designated by the numeral 60.

In operation, the auger 12 is used in conventional manner to bore a hole in the surface of the earth. During this operation, the auger is lowered against the surface to be drilled and, simultaneously, turned in a clockwise direction. The arrow line in FIG. 1 designates the direction of rotation of the auger. The wiper operates by engaging the auger between the convolutions thereof. As so engaged, the screw flight of the auger functions on the periphery of the daisy wheel in much the same way as a worm gear functions with respect to a cooperating pinion. Specifically, rotation of the auger about the axis 18 functions to rotate the daisy wheel 24 about the axis 30. When the auger is driven in a clockwise direction as illustrated in FIG. 1, the daisy wheel 24 rotates about the axis 30 in a counter-clockwise direction.

The rotational mounting of the daisy wheel also permits the auger to be lifted and lowered while the daisy wheel is in engagement therewith. This may be appreciated from FIG. 3 wherein the auger is shown as being lifted upwardly and the daisy wheel is shown as rotating in a clockwise direction responsive to the lifting of the auger. The arrow lines in FIG. 3 are intended to show that the auger is being lifted and that the daisy wheel is rotating about the axis 30 in a clockwise direction.

As the result of the engagement of the fingers 26 between the convolutions 16, the fingers function to scrape or wipe the debris 22 from between the convolutions. This action is depicted in FIG. 1 wherein the removed debris is designated by the numeral 22*a* and shown as resting on the surface of the earth 20.

The hydraulic cylinder 46 provides for the selective movement of the daisy wheel into and out of engagement with the auger. Such movement may be desired for servicing or for use in conditions where the wiper is not necessary. As illustrated, means is also provided to selectively lock the wiper in an engaged or disengaged position. This means comprises detent pins 62 carried by the arms 38 and mating openings 64 and 66 formed in the mounting block 42. To lock the wiper in engaged condition relative to the auger, the detent pins 62 are engaged in the openings 64; and, to lock the wiper in the disengaged condition, the detent pins are engaged in the openings 66. The detent pins 62 are of relatively conventional construction and provided with securing means to selectively lock them in a disengaged condition wherein they do not interfere with swinging of the arms 38 responsive to operation of the cylinder 46.

From the foregoing detailed description, it is believed apparent that the present invention enables the attainment of the objects initially set forth herein. It should be understood, however, that the invention is not intended to be limited to the specifics of the illustrated embodiment, but rather is defined by the accompanying claims.

What is claimed is:

1. In combination with a continuous flight auger having a longitudinal axis with convolutions extending therearound for the transport of drilled debris longitudinally of the auger, an improved wiper for removing debris from the convolutions of the auger, said wiper comprising a wheel having radially extending fingers disposed therearound at uniformly spaced intervals, said fingers being proportioned so as to be engageable between the convolutions of the auger and being spaced relative to one another sufficiently that adjacent fingers may span the convolutions; and, means mounting the wheel for rotation about an axis disposed in a plane generally normal to the longitudinal axis of the auger whereby the fingers interdigitate between the convolutions of the auger and rotation of the auger about the longitudinal axis thereof functions to rotate the wheel around the axis about which it is mounted for rotation.

2. In a combination, according to claim 1, the improved wiper further comprising means for moving the wheel toward and away from the auger whereby fingers of the wheel may be selectively moved into and out of interdigitated condition relative to the convolutions of the auger.

3. In a combination, according to claim 2, the improved wiper wherein the means mounting the wheel comprises an arm structure carrying an axle defining the axis about which the wheel is mounted for rotation and a support pivotally mounting the arm structure for movement about an axis parallel to that about which the wheel is mounted and wherein the means for moving the wheel toward and away from the auger comprises an actuator connected to the arm structure to selectively pivot the structure around the axis about which the structure is mounted.

4. In a combination, according to claim 3, the improved wiper wherein the actuator comprises an expansible and contractable hydraulic cylinder having one end secured to the arm structure in spaced relationship to the axis about which it is mounted and another end secured against movement toward and away from the auger.

5. In combination with a continuous flight auger having a longitudinal axis with convolutions extending therearound for the transport of drilled debris longitudinally of the auger, an improved wiper for removing debris from the convolutions of the auger, said wiper comprising: a successive scraper means engageable between the convolutions of the auger to scrape debris from therebetween upon rotation of the auger about its longitudinal axis and means mounting the scraper means for rotation about an axis disposed in a plane generally normal to the longitudinal axis of the auger to permit the scraper means to move relative to the auger when engaged therewith whereby the scraper means may rotate to successively move into and out of engagement between the convolutions in response to rotational and/or longitudinal movement of the auger.

* * * * *